United States Patent [19]

Lindblom et al.

[11] Patent Number: 5,020,779

[45] Date of Patent: Jun. 4, 1991

[54] METHOD AND AN APPARATUS IN HOT-DIP GALVANIZING

[76] Inventors: Lars Lindblom, Box 87, S-830 05 Jarpen, Sweden; Torstein Evensen, P.O. Box 1108, N-1601 Fredrikstad, Norway

[21] Appl. No.: 469,529

[22] PCT Filed: Jul. 11, 1989

[86] PCT No.: PCT/SE89/00406

§ 371 Date: May 8, 1990

§ 102(e) Date: May 8, 1990

[87] PCT Pub. No.: WO90/00631

PCT Pub. Date: Jan. 25, 1990

[30] Foreign Application Priority Data

Jul. 15, 1988 [SE] Sweden ..... 8802654

[51] Int. Cl.[5] ..... B05C 19/02

[52] U.S. Cl. ..... 266/112; 266/200; 118/429

[58] Field of Search ..... 266/107, 112, 249, 200, 266/44; 118/429, 404

[56] References Cited

U.S. PATENT DOCUMENTS

| | | | |
|---|---|---|---|
| 3,385,262 | 5/1968 | Jacke et al. | 118/429 |
| 3,863,600 | 2/1975 | Van Regenmortel | 118/429 |
| 4,072,777 | 2/1978 | Schoenthaler | 118/429 |
| 4,418,641 | 12/1983 | Nakashima et al. | 118/429 |
| 4,794,018 | 12/1988 | Scheetz | 118/429 |

FOREIGN PATENT DOCUMENTS

| | | |
|---|---|---|
| 1079917 | 4/1960 | Fed. Rep. of Germany . |
| 2063925 | 6/1981 | United Kingdom . |

OTHER PUBLICATIONS

Patent Abstracts of Japan, vol. 10, No. 194 (C-358), Abstract of JP 61-37956, Publ. 2/22/1986.

Patent Abstracts of Japan, vol. 11, No. 8 (C-396), Abstract of JP 61-186463, Publ. 8/20/1986.

Patent Abstracts of Japan, vol. 8, No. 15 (C-206), Abstract of JP 58-181856, Publ. 10/24/1983.

Patent Abstracts of Japan, vol. 9, No. 108 (C-280), Abstract of JP 60-2654, Publ. 8/01/1985.

Patent Abstracts of Japan, vol. 9, No. 228 (C-303), Abstract of JP 60-86258, Publ. 5/15/1985.

*Primary Examiner*—S. Kastler

*Attorney, Agent, or Firm*—Ladas & Parry

[57] ABSTRACT

A method and apparatus for avoiding the formation of impurities in a coating produced by hot-dip galvanizing of an object in a zinc bath. One or more flows of molten and pure zinc are, in a container, provided which are directed towards a surface region (4), i.e. the working surface (4), where the object passes on being immersed in and raised from the bath, respectively. As a rule, a surface flow is caused to pass from the one edge region (27) of the container, to its other edge region (29), any possible impurities (6) located on the surface of the bath being displaced from the working surface. The apparatus according to the disclosure includes a pump (25a) which, via a discharge pipe (33) supplies molten zinc to a gutter (26) in the upper region of a container (10). Opposing the gutter, the container is provided with a channel (31). The gutter and channel, respectively, have opposing walls with respective edges (27) and (29) over which molten zinc passes. The upper edge of the gutter is, as a rule, located higher than the edge of the channel.

12 Claims, 4 Drawing Sheets

METHOD AND AN APPARATUS IN HOT-DIP GALVANIZING

FIELD OF THE INVENTION

The present invention relates to a method and an apparatus for in hot-dip galvanizing in which the coating formed during the galvanizing process no longer undesirable impurities accompanying from the bath of molten zinc.

DESCRIPTION OF PRIOR ART

In the hot-dip galvanizing of an object, for example of iron, steel etc., the object is immersed in a bath of molten zinc, the iron and zinc forming alloys with one another. The alloys build up a coating of iron-zinc layers on the object, in which the layers have a decreasing iron content towards the coating surface. As a rule, the coating closest to the surface consists of substantially pure zinc which, on removal of the object from the bath, has adhered to the coating of iron-zinc already formed in the bath. A number of factors such as the solidifying process, the composition of the iron, the condition of the iron surface, the composition and temperature of the molten zinc, the immersion time, etc. determines the thickness and quality of the coating which is formed.

In order to attain fully adequate quality in the galvanizing, it is necessary that part of the surface of the zinc bath through which the article passes during its immersion and removal be free of impurities. Within this art, use is made of the expression "working surface" for that portion of the surface of the bath through which the article passes. As a rule, the zinc surface of the bath is covered by impurities which, primarily, consist of oxides and flux residues. These impurities must be removed from the working surface before the article passes therethrough, since such impurities would otherwise accompany the article and cause a deterioration in the quality of the coating which is formed on the article in the galvanizing process.

It is known in this art to employ different types of mechanical devices in order to remove mechanically the impurities from the working surface. In certain cases the mechanical devices move the impurities floating on the zinc surface towards the edges of the container (bath of "pot") in which the molten zinc is located, while in other physical applications, such removal is supplemented by means of frothing the impurities and raising them from the zinc bath. However, it is difficult to ensure that the working surface is completely exposed and free of impurities and, according to prior art technology, the time consumed for cleaning the working surface may be unacceptably high, whereby the capacity of the galvanizing plant is reduced and/or that the thickness of the coating will be undesirably large. In both cases, extra costs are incurred for the hot-dip galvanizing which is carried out. Because of the uncertainty which always prevails in respect of efficiency in the removal of impurities from the working surface, the technology currently employed requires continual monitoring of the galvanizing process in order to attain the contemplated quality of the coating on those articles which are hot-dip galvanized.

It is desirable within this art to be able, as far as is possible, to automize the hot-dip galvanizing process, but such desire is difficult to reconcile because of the inherent problems involved in exposing and freezing the working surface from impurities preparatory to the passage of the article through the working surface. Automation of the process is particularly desirable in view of the severe environment surrounding the hot-dip galvanizing bath.

SUMMARY OF THE INVENTION

An object of the present invention is to provide a method and an apparatus which satisfy the requirements and objectives as set forth in the preceding paragraph. The present invention obviates essentially all requirements of manual monitoring of the hot-dip galvanizing process.

In one preferred embodiment of the present invention, the flow movement of molten and pure zinc is directed substantially from beneath towards the working surface in order thence to continue, in the surface region of the bath, in a direction away from the working surface. In such event, all possible impurities on the working surface will always be conveyed away from the surface.

In a further preferred embodiment, the above-mentioned flow movement is directed substantially from a first region of the bounding definition of the container towards a second region of this bounding definition. Any possible impurities will, in this instance, accompany the flow of zinc, and impurities which are located in the region of the working surface are displaced away from the surface.

DETAILED DESCRIPTION OF PREFERRED EMBODIMENTS

Figure 1:
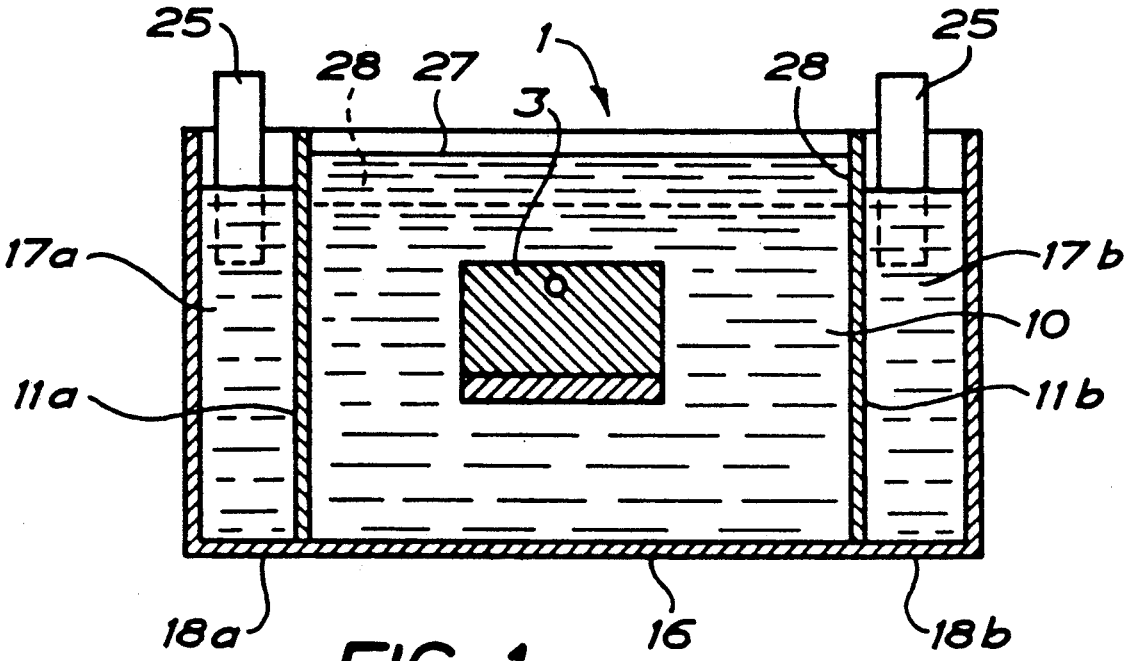
FIG. 1 is a longitudinal section taken on line I—I in FIG. 2 through an apparatus for hot-dip galvanizing.

The embodiment, shown in FIGS. 1-3*c*, of an apparatus 1 according to the present invention includes a container 10 substantially of box form containing a bath 2 of molten zinc. The container is defined by two substantially opposing short end walls 11*a*, 11*b*, two substantially opposing longitudinal walls 12*a*, 12*b* located therebetween, and a closed bottom 16. In the upper region of the container, and along the longitudinal walls thereof, there are provided two mechanical devices 26, 31 facing towards the center plane of the container and towards each other, the first forming at least one gutter 26 and the second at least one channel 31. The short walls, the longitudinal walls, the bottom, the gutter and the channel are included in the outer bounding surface 28 of the container in which the bath of molten zinc is confined. In such instance the gutter forms a first upper defining edge 27 and the channel 31 forms a second upper defining edge 29 for the bounding surface 28 of the container. In one preferred embodiment, the first upper defining edge 27 is located at a higher level than the second upper defining edge 29 (cf. FIG. 3*a*), in addition to which the defining edges are of substantially horizontal orientation. In certain applications, the second upper defining edge may be replaced and/or supplemented by one or more run-off apertures and/or recesses which, as a rule, are also located at a level lower than the lowest level of the above-mentioned substantially horizontal first upper defining edge 27.

In association with short wall 11*a*, there is a first side region or container 17*a* and in association with the second short wall 11*b*, a second side region or container 17*b*. Both of said containers each have a sealed bottom 18*a*, 18*b*, each located at a level which is lower than the bottom 32 of the channel 31. Pumps 25 are provided in association with each respective side container 17*a*, 17*b* and have outlet means 24, for example an outlet pipe which discharges in the cutter 26.

Figure 2:
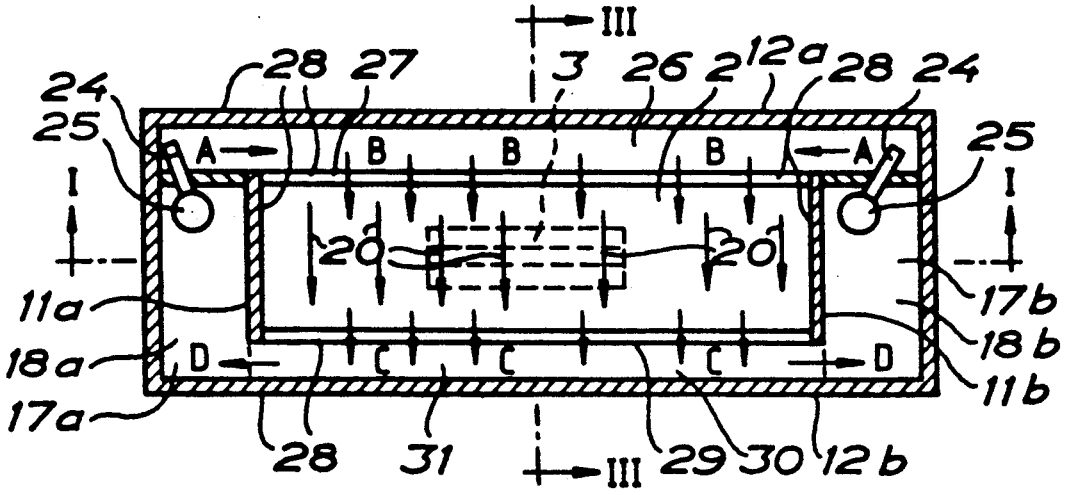
FIG. 2 is a horizontal section taken on line II—II in FIG. 3*a* through the apparatus.
Figure 3A:
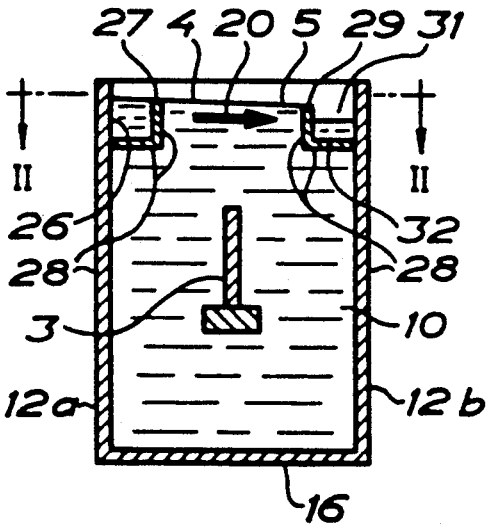
FIG. 3*a* is a cross-section taken on line III—III in FIG. 2 through the apparatus.
Figure 3B:
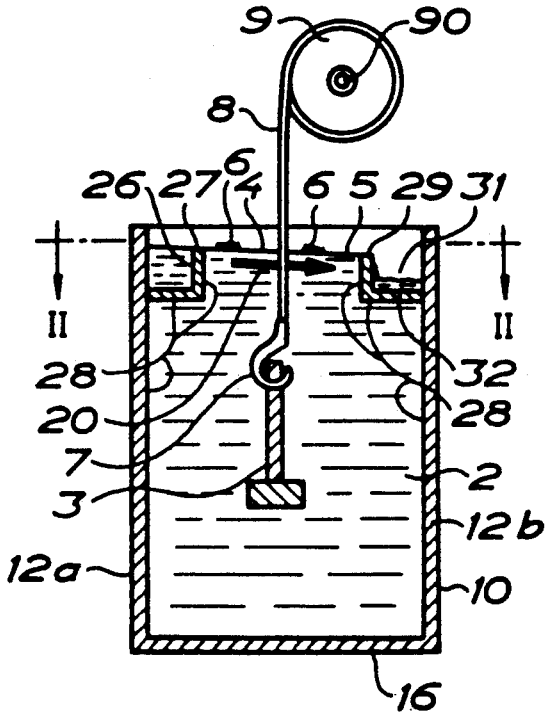
FIG. 3*b* is a section corresponding to section III—III in FIG. 2 for a container filled with zinc.
Figure 3C:
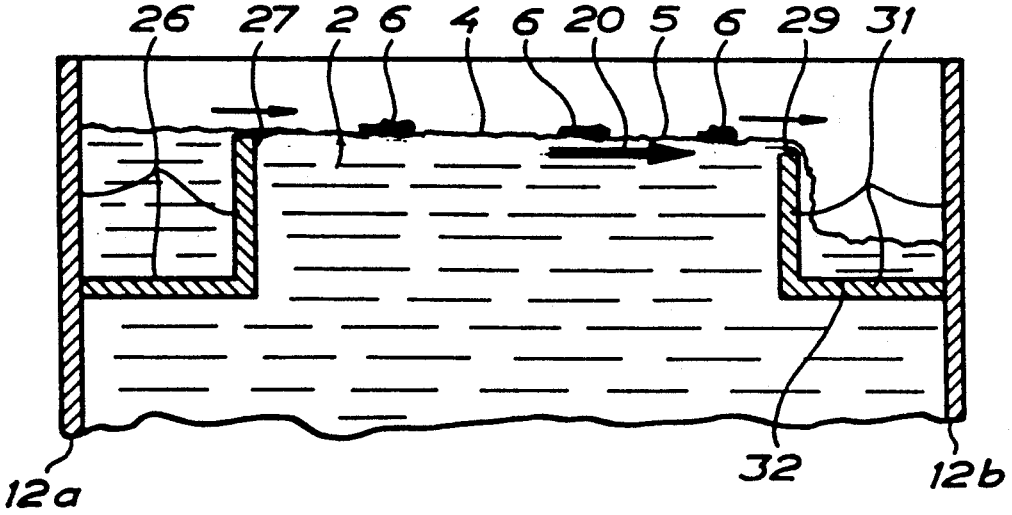
FIG. 3*c* shows the upper region of FIG. 3*b* on a larger scale.

FIGS. 3*b* and 3*c* illustrate in particular how the container 10 is filled with the bath 2 of molten zinc, and how the upper surface 5 of the bath forms, main central surface region 4, a working surface 4. On the surface 5 of the bath, impurities 6 are also marked in FIG. 3*c*, these impurities being, for instance, flux residues. FIG. 3*b* shows one embodiment in which an object 3 (cf. also FIG. 2) which is located in the bath 2 is suspended from a hook 7 which, via a wire 8, is connected to a drum 9 which, through the intermediary of drive means (not shown in FIGS. 3*b* and 3*c*) is rotated about a shaft 90 for the immersion and raising of the article into and out of the bath. Generally, the hook 7 and its associated means have been omitted for purposes of simplifying the other figures. It will be obvious to one skilled in the art that, in practical embodiments, the means for immersing the object into the bath and raising the object from the bath are designed so as to adapt to such factors as the configuration and weight of the object.

It will further be obvious to one skilled in the art that there are provided, in association with the container, heating devices and control devices for adjusting the temperature of the bath to a desired level. Such devices are selected in view of the particular requirements which prevail in each embodiment of the container employed and those hot-dip galvanizing processes which are currently applicable to the galvanizing plant.

For purposes of clarity, the object 3 is also illustrated in FIG. 2 in dotted outline even though it is wholly surrounded, in this figure, by the zinc bath and is, in reality, not visible by broken lines. In FIG. 2, the arrows A–D show how molten zinc flows to and from the container 10 (cf. also FIG. 3*c*).

In operation, the container 10 is filled with the bath 2 of molten zinc. A certain volume of molten zinc is also to be found in the first and second side containers, 17*a* and 17*b*, respectively. The temperature of the molten zinc is adjusted to a level which is adapted to the hot-dip galvanizing process which is to be employed. Zinc is moved by means of the pumps 25 from the side containers 17*a*, 17*b* to the gutter 26, and the zinc flows, in this instance, in the direction of the arrows A towards the central portions of the gutter 26. In such instance, the gutter is filled with molten zinc to a level which entails that the zinc passes over the first upper defining edge 27 (cf. the arrows B) of the container and into the container 10. Since the second upper defining edge 29 of the container is located at a slightly lower level than the first defining edge 27, a surface flow 20 of zinc will occur from the first defining edge to and over (cf. the arrows C) the second defining edge. In such instance, impurities 6 located on the surface of the bath 2, will accompany the surface flow of zinc and pass via the second upper defining edge down into the channel 31 and thence further to the side containers 17*a*, 17*b*. The zinc supplied from the channel 31 is added to the zinc located in the side containers, for which reason the side containers will hold a substantially constant volume in time of molten zinc on whose surface the supplied impurities will float. The pumps 25 are disposed with their suction intake apertures ar such a level in the side containers that substantially pure zinc is sucked into the pumps, while the impurities 6 remain on each respective zinc surface in the side containers, at the same time as those depositions which are formed in the region of the bottom 18*a*, 18*b* of the side containers are not affected by the suction of molten zinc to the pumps. The pumps supply the zinc to the gutter 26 which, thereby, is fed with that additional supply of zinc which is required in order that the previously described flow movements may continue.

Before immersing the object 3 in the bath or raising the object from the bath, the supply of zinc to the gutter 26 is stopped, whereby the flow of zinc from the first upper defining edge 27 towards the second upper defining edge 29 ceases. Since substantially pure zinc had previously passed over the first upper defining edge towards the second upper defining edge 29, essentially all impurities 6 will be moved from the zinc surface 5 to the channel 31, and consequently, on passage of the object through the working surface, there will be no impurities associated therewith which may adhere to the object when it passes through the working surface. After this passage, the supply of molten zinc is recommenced to the gutter 26, whereby the above-described cycling of zinc continues.

In order to automize the hot-dip galvanizing process, in certain embodiments of the present invention, the devices for handling the objects in conjunction with their immersion in and raising from the bath, and the devices which provide the flow (the cycling) of zinc are regulated, by means of control devices, such that the flow of molten zinc to the gutter 26 is discontinued at a pre-adjustable point in time and before the object 3 passes through the working surface 4. The time interval between the discontinuation of the supply of molten zinc to the bath 2 over the first defining edge 27 and the passage of the object through the working surface 5 is adjusted taking into account such factors as the size of the container, the capacity of the pumps, the temperature of the bath, the time which elapses for the formation of zinc oxide on the surface of the bath, etc.

Figure 4:
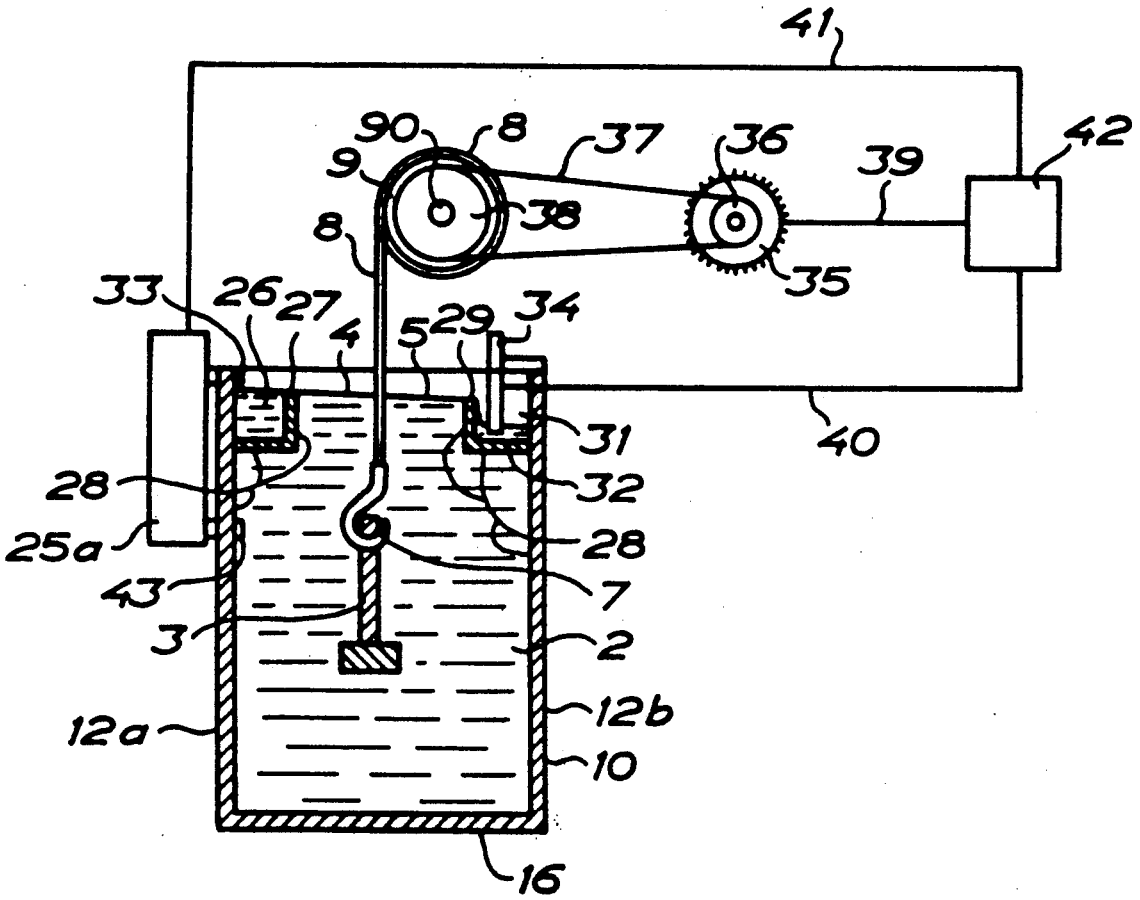
FIG. 4 is a section taken on line III—III in FIG. 2 supplemented with a schematic block diagram of an automatically operating apparatus for hot-dip galvanizing.

FIG. 4 shows one example of an embodiment of an apparatus according to the present invention in which the apparatus is adapted to automatize the hot-dip galvanizing process in accordance with the principles indicated in the preceding paragraph. The section illustrated in FIG. 4 corresponds substantially to a section which is to be found in FIGS. 3*a*–3*c*. In addition to those devices which are illustrated in these figures, FIG. 4 shows one or more pumps 25*a* disposed beside the container and provided with one or more suction intake pipes 43 connected to the container 10 at a level which is located below the level of the surface 5 of the zinc bath when the hot-dip galvanizing process is carried out. In addition, the pump 25*a* is provided with at least one discharge pipe 33 which is shown in the figure as discharging in a region above the gutter 26.

In association with the channel 31, a transducer 34 is provided for detecting the surface level of the molten zinc which is located in the channel, or alternatively the absence of molten zinc in the channel 31. From the channel, the molten zinc flows down into a container (not shown) corresponding to the side containers 17*a*, 17*b*, whence the zinc is recycled to the bath, for example by means of separate pumps (not shown) or by means of the pump or pumps 25*a* shown on the drawing. The drum 9 for uncoiling or winding up the wire 8 in the immersion or raising of the object 3 into or from the bath 2 is, in FIG. 4, shown as being provided with a drive pinion 38 which, through the intermediary of a connecting means 37, for example a cog belt, is driven by the drive wheel 36 of a motor 35. The motor 35 is coupled via a signal communication means 39 to a registration and control device 42. The device 42 is also connected via signal communication means 40 and 41, respectively, to the transducer 34 and the pump (pumps) 25*a*, respectively.

When the apparatus according to the embodiment illustrated in FIG. 4 is operated, the container 10 is filled with the bath 2 of molten zinc. The pump or pumps 25*a*, respectively, suck molten zinc from a region in the bath 2 located well below the surface 5 of the bath and supply the zinc to the gutter 26. In accordance with the earlier description, a flow will thereby occur of molten zinc from the gutter 26 to the channel 31. Since the zinc extracted by suction from the interior of the bath is substantially pure, any possible impurities on the surface of the zinc bath will, as a result of the flow of zinc along the surface of the zinc bath, be moved to the channel 31. In certain embodiments, the molten zinc is caused to pass through a purification chamber, for instance corresponding to the previously-described side containers 17*a*, 17*b*, before being supplied to the gutter 26.

Prior to the displacement of an object down into the zinc bath, the registration and control device 42 stops the pump or pumps 25*a*, respectively, via the signal communication means 41 and awaits a signal from the transducer 34 that the zinc surface of the molten zinc in the channel 31 has fallen below a certain level, in order to ensure that the flow of molten zinc towards the channel 31 has ceased. When this signal is received, the registration and control device 42 starts, via the signal communication means 39, the motor 35 for uncoiling the wire from the drum 9, the object 3 being immersed in the zinc bath. The working surface 5 of the zinc bath is, in this instance, wholly free of impurities and zinc oxides. When the object is immersed to a predetermined depth in the zinc bath, the registration and control device stops the motor and, via the signal communication means 41, starts the pump or pumps 25*a*, respectively, in order to recommence the flow of molten zinc to the gutter 26 and, thereby, the flow therefrom towards the channel 31.

After a certain time which is adjustable and adapted in compliance with the actual hot-dip galvanizing process, the registration and control device 42 once again stops via the signal communication means 41, the operation of the pump or pumps 25*a*, respectively, via the signal communication means 41, awaits the signal for the registration and control device from the transducer 34 that the zinc level in the channel 31 has fallen below a certain predetermined level and thereafter emits a signal via the signal communication means 39 to the motor 35 to raise the object 3 from the bath. In accordance with the description of the immersion of the object, the working surface is, on raising of the object from the bath, wholly free of impurities and zinc oxide. When the object has been raised from the bath, it is removed from the suspension device 7, for example by means of a robot (not shown) which also places a new object in the suspension device, whereafter the previously described cycle is repeated.

In one alternative embodiment, the registration and control device is adjusted so as to emit a signal to start the motor 35 and, thereby, the immersion and raising, respectively, of the object after a time period established with reference to the capacity and size of the bath, after the supply of molten zinc to the gutter 26 had ceased in that a signal is emitted to the pump or pumps 25*a*, respectively to stop work.

In certain embodiments, continual supply is effected of molten and pure zinc to the region of the working surface in that the zinc is, by means of mechanical devices, for example pumps, impellers etc., caused to assume a flow movement entailing that zinc from the central region of the bath is displaced from beneath towards the working surface in the form of upwardly-directed flows of zinc, whence the pure zinc continues towards the defining walls of the container (crucible) in the form of surface currents. The zinc bath will, in a central region of the working surface, thereby be freed of impurities. As a rule, the zinc is displaced with accompanying impurities from the region adjacent the defining walls of the container via overflows to receptacles in which any possible impurities occuring in the zinc are separated, whereafter the molten zinc is recycled to the bath.

Figure 5:
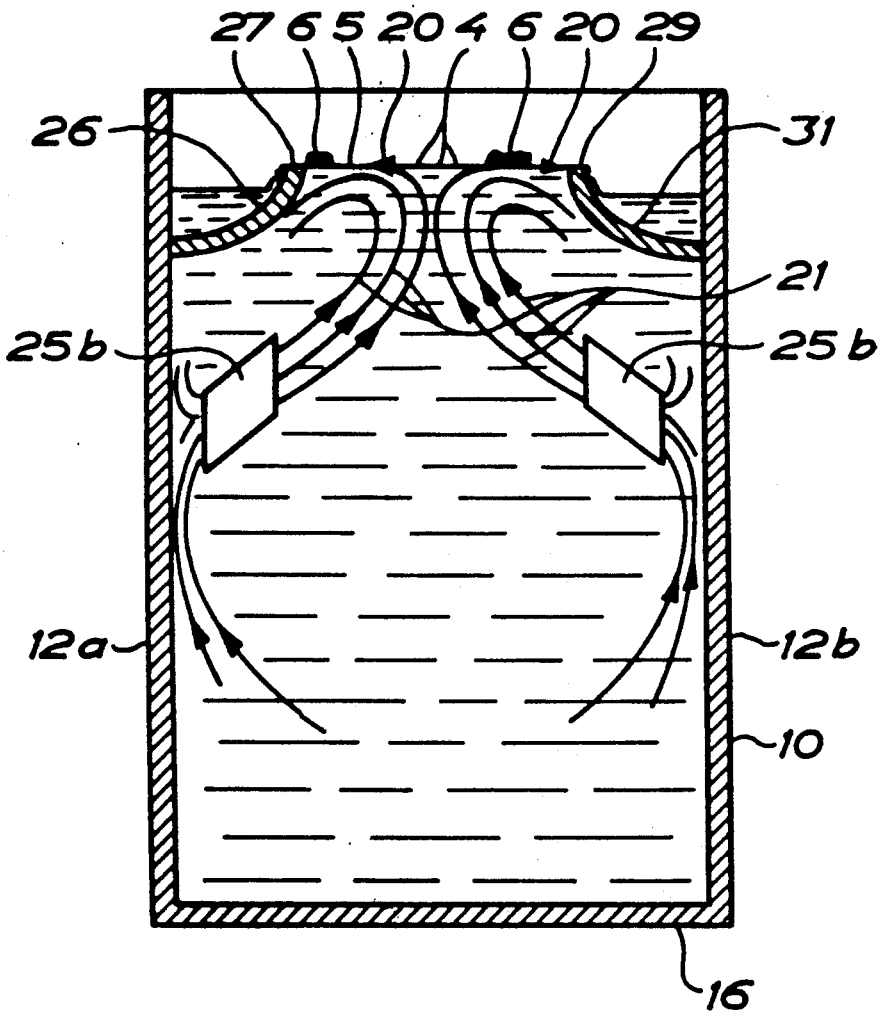
FIG. 5 is a section taken on line III—III in FIG. 2 in an alternative embodiment of the apparatus according to the present invention.

FIG. 5 illustrates an embodiment of an apparatus according to the present invention adapted to permit continual supply of molten and pure zinc to the region of the working surface 4. The section shown in the figure corresponds essentially to those sections which are to be found in FIGS. 3*a*–3*c* and FIG. 4. The apparatus comprises a plurality of pumps 25*b* disposed along each respective longitudinal wall 12*a*, 12*b* of the container 10. The zinc which is discharged from the pumps is directed thereby obliquely inwardly and upwardly, so that the flow 21 of zinc which are formed meet one another in the region of a vertical center plane located between the pumps and between the first upper defining edge 27 and the second upper defining edge 29. Consequently, the current flows of zinc change direction beneath the region of the working surface 4 and continue in the form of surface flows 20 along the zinc surface 5. Hereby, a layer of zinc is created which passes over the two defining edges 27, 29 into the gutter 26 and the channel 31, respectively. From the gutter and channel, respectively, the molten zinc runs down into a container (not shown) corresponding to the side containers 17*a*, 17*b*, wherefrom the zinc is recycled to the bath. The surface flow 20 of molten zinc which passes from the working surface to the gutter and the channel, respectively, entrains impurities 6 located on the zinc surface, at the same time as the flow of zinc which is supplied to the zinc surface from beneath consists of pure zinc from the interior of the bath. It will hereby be ensured that, in the area of the working surface 4, the working surface will be free of impurities. It will be obvious to one skilled in the art that the embodiment illustrated in FIG. 5 is also capable of use for intermittent operation of the pumps 25*b* in accordance with an operation program corresponding to that described above.

What is claimed is:

1. In the method of galvanizing an object by immersion of the object in a bath of molten zinc in a box-like container having longitudinal side walls and transverse end walls, said bath having a working surface through which the object passes upon immersion into and removal from the bath, the improvement comprising providing a flow of substantially pure molten zinc in the zinc bath at the working surface thereof to convey away any surface impurities at said working surface so that during passage of the object through the working surface of the bath the object will not come into contact with impurities, said flow of substantially pure molten zinc at said working surface being effected by forming a gutter along one longitudinal side wall of the container and a channel along the other longitudinal side wall of the container, said container having a main region between the gutter and the channel containing molten zinc having a surface constituting said working surface, producing a transverse flow of said molten zinc at said working surface in the main region of the container by causing the molten zinc to flow from the gutter to the channel, passing the molten zinc in said channel in the longitudinal direction of the container to a side region in the container in which the zinc bath is isolated from said main region and from said gutter, and pumping the molten zinc from said side region into said gutter from a lower depth of the molten zinc in said region where the molten bath is substantially pure.

2. The improvement as claimed in claim 1 comprising halting said flow when said object passes through said working surface.

3. The improvement as claimed in claim 1 comprising causing the molten zinc to flow in said channel in opposite longitudinal directions to respective side regions proximate the end walls of the container, pumping the molten zinc from both side regions into said gutter and producing longitudinal flow of the molten zinc pumped into the gutter from said side regions longitudinally towards one another and then to said working surface.

4. The improvement as claimed in claim 3 comprising effecting the immersion and removal of the object in said main region of the container.

5. The improvement as claimed in claim 1 wherein the molten zinc flows from said gutter to said channel by flowing over a wall of the gutter towards a lower wall of the channel.

6. Apparatus for the hot-dip galvanizing of objects comprising a box-like container containing a bath of molten zinc having a working surface through which the object to be galvanized passes during immersion of the object into and removal of the object from the zinc bath, said container having longitudinal side walls and transverse end walls, and means for producing a flow of substantially pure molten zinc in the zinc bath at said working surface to convey away any surface impurities at said working surface, so that during passage of the object through the working surface the object will not come into contact with impurities, said means comprising a gutter disposed along one longitudinal side wall of the container, a channel disposed along the other side wall of the container, a main bath region between the gutter and the channel, the bath in said main region having a surface constituting said working surface, said gutter and said channel each having respective walls bounding the bath in the main region at said working surface, enabling the molten zinc in the gutter to overflow past its wall as a thin layer at said working surface to and past the wall of the channel for conveying away any surface impurities at said working surface, a side region in the container communicating with said channel for receiving molten zinc therefrom, said side region being isolated from said main region and from said gutter, and pump means for pumping molten zinc from said side region into said gutter from a lower depth of the molten zinc in said side region where the molten bath is substantially pure.

7. Apparatus as claimed in claim 6 wherein the means which enables the flow of the molten zinc from the gutter to the channel is constituted by a position of the top of the wall of the gutter at a higher level than the top of the wall of the channel.

8. Apparatus as claimed in claim 7 comprising a second side region communicating with said channel, each of said side regions being proximate a respective end wall of the container, and a second pump means for pumping molten zinc from the second side region into said gutter, the first and second pump means supplying molten zinc to said gutter at opposite ends thereof so that the pumped molten zinc flows in the gutter along longitudinal flow paths towards one another and then over the wall of the gutter to said working surface of the molten bath in said main region.

9. Apparatus as claimed in claim 6 further comprising drive means for raising and lowering an object to be hot-dip galvanized in said bath, and control means connected to said drive means and to said pump means to halt supply of molten zinc to the bath prior to immersion of the object into the bath and removal of the object from the bath.

10. Apparatus as claimed in claim 9 further comprising transducer means for sensing the flow of the layer in said zinc bath at said working surface, said transducer means being coupled to said control means for activating said drive means when the flow of zinc falls below a predetermined level.

11. Apparatus as claimed in claim 10 wherein said transducer means is operatively associated with said channel.

12. Apparatus as claimed in claim 10 wherein said transducer means measures the level of zinc in said channel.

* * * * *